US005231764A

United States Patent [19]

Chang

[11] Patent Number: 5,231,764

[45] Date of Patent: Aug. 3, 1993

[54] CUTTER FOR A PLASTERBOARD SHEET

[76] Inventor: Kenneth Chang, 47-425 Mahakea Rd., Kaneohe, Hi. 96744

[21] Appl. No.: 893,035

[22] Filed: Jun. 3, 1992

[51] Int. Cl.[5] ..... B26B 29/00

[52] U.S. Cl. ..... 30/293; 30/294

[58] Field of Search ..... 30/164.9, 164.95, 292, 30/293, 294; 83/745

[56] References Cited

U.S. PATENT DOCUMENTS

| | | | |
|---|---|---|---|
| 2,090,183 | 8/1937 | Capstick | 30/293 |
| 2,818,644 | 1/1958 | Crawford | 30/293 |
| 4,231,275 | 11/1980 | Onishi | 83/745 |
| 4,649,647 | 3/1987 | Kaulfuss | 30/294 |
| 4,903,409 | 2/1990 | Kaplan et al. | 30/293 |
| 4,949,462 | 8/1990 | Spencer | 30/293 |
| 4,979,304 | 12/1990 | Sprague | 30/293 |

*Primary Examiner*—Hien H. Phan
*Attorney, Agent, or Firm*—Michael I. Kroll

[57] ABSTRACT

An improved cutter is provided for a plasterboard sheet, used in conjunction with a conventional T-square having a head and an elongated rule extending at a right angle from the head. The improved cutter consists of a mechanism for retaining a utility blade on the elongated rule of the conventional T-square in a proper position. When the head of the conventional T-square slides along one straight edge of the plasterboard sheet, the utility blade will make a score line across the plasterboard sheet, whereby a piece of the plasterboard sheet can then be snapped off.

6 Claims, 2 Drawing Sheets

CUTTER FOR A PLASTERBOARD SHEET

BACKGROUND OF THE INVENTION

1. Field of the Invention

The instant invention relates generally to wallboard tools and more specifically it relates to an improved cutter for a plasterboard sheet.

2. Description of the Prior Art

Numerous wallboard tools have been provided in prior art that are adapted to be utilized in wall construction of prefabricated materials, such as gypsum plaster encased in paper or compressed wood fibers and chips, which are a substitute for plaster and wood panels. While these units may be suitable for the particular purpose to which they address, they would not be as suitable for the purposes of the present invention as heretofore described.

SUMMARY OF THE INVENTION

A primary object of the present invention is to provide an improved cutter for a plasterboard sheet that will overcome the shortcomings of the prior art devices.

Another object is to provide an improved cutter for a plasterboard sheet used in conjunction with a conventional T-square, in which the improved cutter contains a adjustable locking utility blade holder, that will make a score line across the plasterboard sheet when the conventional T-square slides therealong, so that a piece of the plasterboard sheet can be snapped off.

An additional object is to provide an improved cutter for a plasterboard sheet in which the utility blade can be adjusted to make score lines into plasterboard sheets of various thicknesses.

A further object is to provide an improved cutter for a plasterboard sheet that is simple and easy to use.

A still further object is to provide an improved cutter for plasterboard sheet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
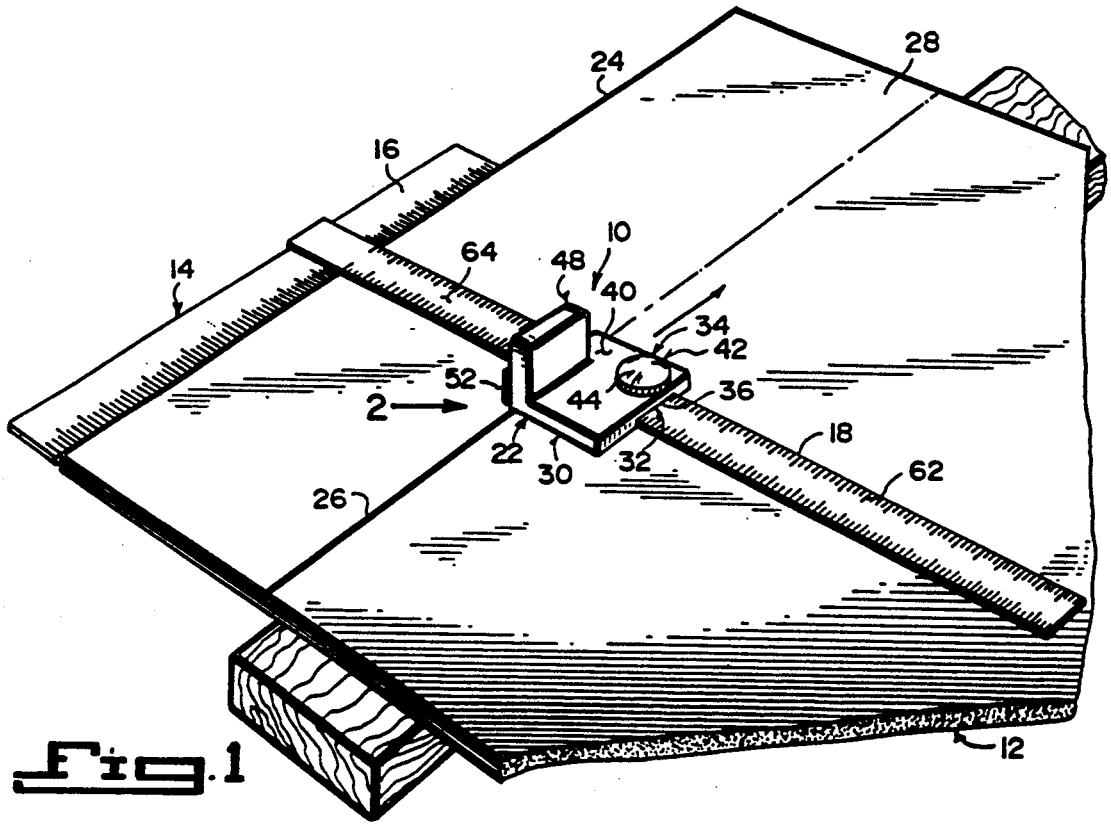
FIG. 1 is a perspective view of the instant invention being used in conjunction with a conventional T-square for making a score line across a plasterboard sheet.
Figure 2:
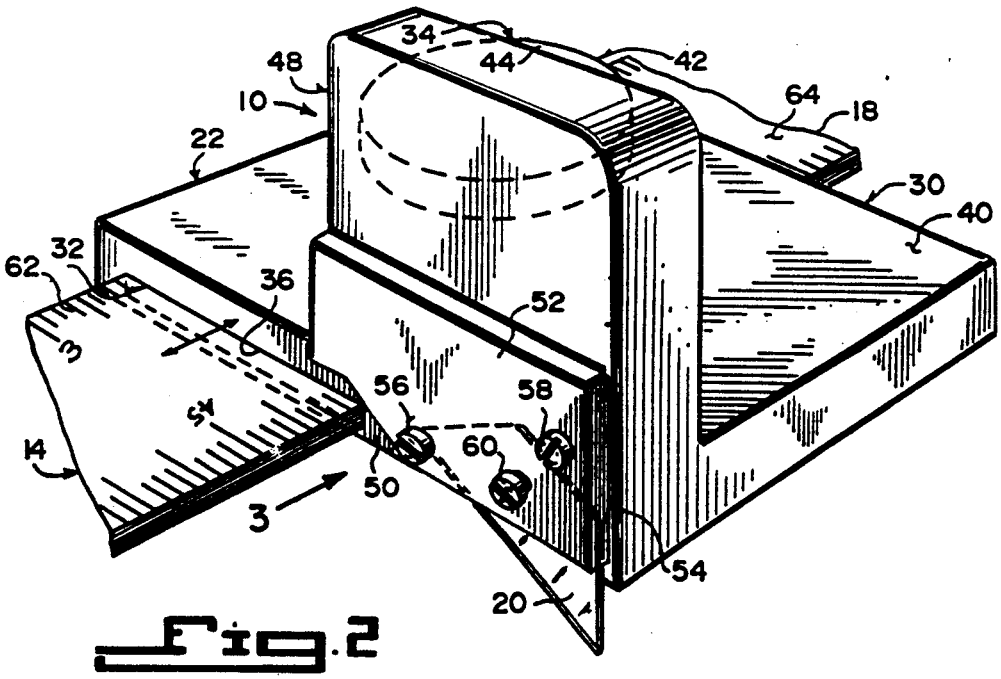
FIG. 2 is an enlarged perspective view taken in direction of arrow 2 in FIG. 1 with the elongated rule broken.
Figure 3:
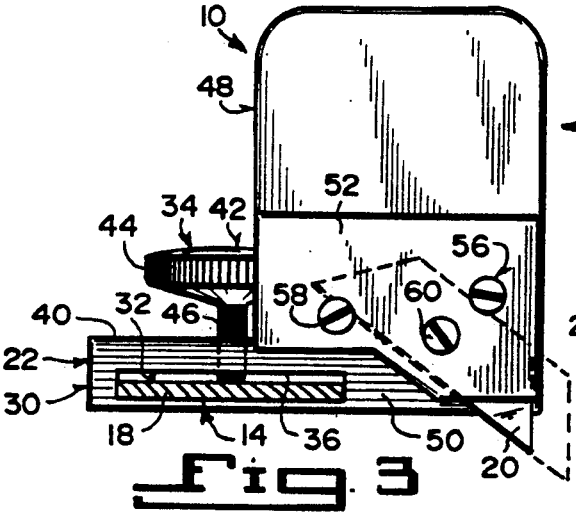
FIG. 3 is an end view taken in direction of arrow 3 in FIG. 2.
Figure 4:
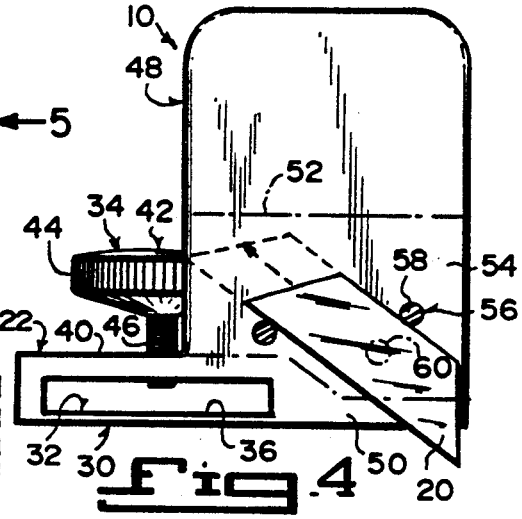
FIG. 4 is an end view similar to FIG. 3 with the elongated rule and the pressure plate removed therefrom.
Figure 5:
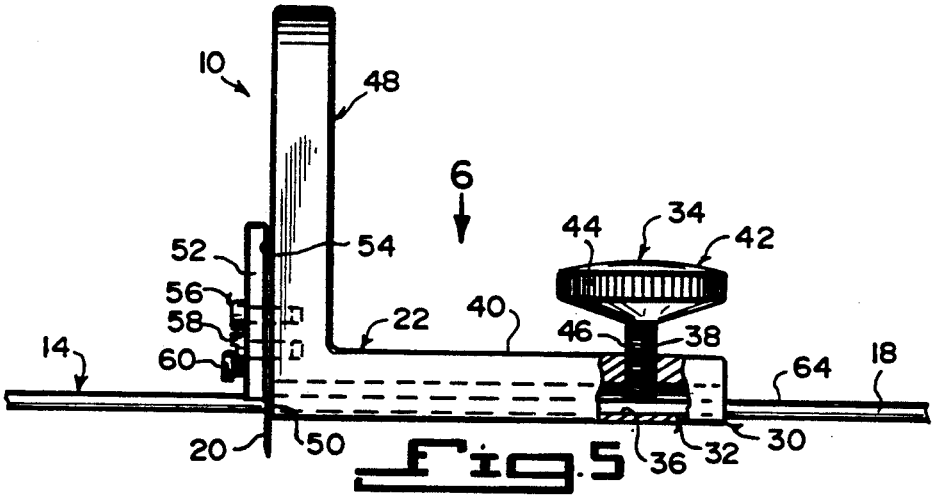
FIG. 5 is a side view taken in direction of arrow 5 in FIG. 3 with part of the base member broken away at the locking thumbscrew location.
Figure 6:
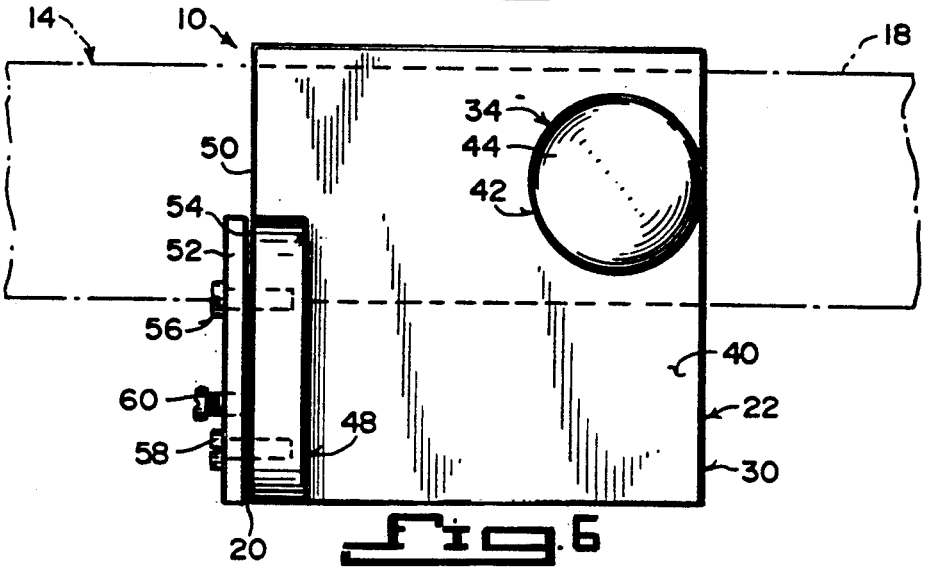
FIG. 6 is a top view taken in direction of arrow 6 in FIG. 5 with the broken elongated rule shown in phantom.

Turning now descriptively to the drawings, in which similar reference characters denote similar elements throughout the several views, the Figures illustrate an improved cutter 10 for a plasterboard sheet 12, used in conjunction with a conventional T-square 14 having a head 16 and an elongated rule 18 extending at a right angle from the head 16. The improved cutter 10 consists of a utility blade 20 and a mechanism 22 for retaining the utility blade 20 on the elongated rule 18 of the conventional T-square 14 in a proper position. When the head 16 of the conventional T-square 14 can slide along one straight edge 24 of the plasterboard sheet 12, the utility blade 20 will make a score line 26 across the plasterboard sheet 12, whereby a piece 28 of the plasterboard sheet 12 can then be snapped off.

The retaining mechanism 22 is composed of a base member 30 and a structure 32, in the base member 30, for receiving the elongated rule 18 of the conventional T-square 14. Another structure 34, in the base member 30, is for locking the elongated rule 18 of the conventional T-square 14 within the receiving structure 32 in the retaining mechanism 22.

For the receiving structure 32 includes the base member 30 has a longitudinal slot 36 extending therethrough, whereby the slot 36 is of a size to act as a track to receive the elongated rule 18 of the conventional T-square 14. The locking structure 34 includes the base member 30 having a threaded hole 38 extending through a top surface 40 into the slot 36. A thumbscrew 42 having an enlarged head 44 and a threaded shank 46 enters into the threaded hole 38, so that a distal end of the threaded shank 46 can bear against the elongated rule 18 of the conventional T-square 14.

The retaining mechanism 22 further contains an arm member 48 extending upwardly from one end 50 of the base member 30 off to one side of the slot 36. A pressure plate 52 is placed against a lower forward side 54 of the arm member 48. Fasteners 56 are for securing the utility blade 20 between the pressure plate 52 and the lower forward side 54 of the arm member 48 in the proper position. When the threaded shank 46 of the thumbscrew 42 bears against the elongated rule 18 of the conventional T-square 14, a person can grip the arm member 48 and slide the head 16 of the conventional T-square 14 along the one straight edge 24 of the plasterboard sheet 12.

The fasteners 56 are a pair of spaced apart pressure plate screws 58 and a utility blade screw 60. Each pressure plate screw 58 extends through the pressure plate 52 and into the arm member 48. The utility blade 20 can be placed in the proper position in a downwardly angular direction by the pressure plate screws 58, between the pressure plate 52 and the lower forward side 54 of the arm member 48. The utility blade screw 60 extends through the pressure plate 52 to bear against the utility blade 20, so as to keep it stationary in the proper position.

The base member and the arm member 48 are integral, with the one end of the base member 30 and the lower forward side 54 of the arm member 48 aligned to form a flat surface therebetween.

The elongated rule 18 of the conventional T-square 14 can contain a calibrated scale 62 placed upon a top surface 64 thereof. The end 50 of the base member 30 can be set at an identifiable location on the calibrated scale 62, in which the piece 28 of the plasterboard sheet 12 that is snapped off along the score line 26 can be precisely measured. The improved cutter 10 can cut off or leave the piece 28 of the plasterboard sheet 12 from zero inches to forty eight inches of a forty eight inch wide plasterboard sheet 12.

The base member 36, the arm member 48, the pressure plate 52, the pressure plate screws 58 and the utility blade screw 60 are all fabricated out of one of a number of durable materials, typically but not limited to metal and plastic.

LIST OF REFERENCE NUMBERS

10: improved cutter
12: plasterboard sheet
14: conventional T-square
16: head of 14
18: elongated rule of 14
20: utility blade
22: retaining mechanism
24: one straight edge of 12
26: score line across 12
28: piece of 12
30: base member
32: receiving structure in 30
34: locking structure in 30
36: longitudinal slot in 30 for 32
38: threaded hole in 30
40: top surface of 30
42: thumbscrew
44: enlarged head of 42
46: threaded shank of 42
48: arm member
50: one end of 30
52: pressure plate
54: lower forward side of 48
56: fastener
58: pressure plate screw for 56
60: utility blade screw for 56
62: calibrated scale on 18
64: top surface of 18

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved cutter for a plasterboard sheet used in conjunction with a conventional T-square having a smooth head free of irregularities and a smooth elongated rule also free of irregularities extending at a right angle from the smooth head, said improved cutter comprises:

a) a utility blade; and b) means for retaining said utility blade on the smooth elongated rule of the conventional T-square in a proper position, so that when the smooth head of the conventional T-square slides along one straight edge of the plasterboard sheet, said utility blade will make a score line across the plasterboard sheet, so that a piece of the plasterboard sheet can then be snapped off, said retaining means includes a smooth base member free of irregularities and having two ends, means in said smooth base member for receiving the smooth elongated rule of the conventional T-square, said receiving means includes said smooth base member having a longitudinal slot extending end to end therethrough, so that said longitudinal slot is of a size to act as a track to receive the smooth elongated rule of the conventional T-square, means in said smooth base member, for locking the smooth elongated rule of the conventional T-square within said receiving means in said retaining means, said locking means includes said smooth base member having a threaded hole extending through a top surface into said longitudinal slot, and a thumbscrew having an enlarged head and a threaded shank which enters into said threaded hole, so that a distal end of the threaded shank can bear against the smooth elongated rule of the conventional T-square, a smooth arm member extending upwardly form one of said ends of said smooth base member and off to one side of said longitudinal slot and being perpendicular to said smooth base member and having rounded upper corners, forming a hand grip for user comfort, a smooth pressure plate free of irregularities and placed against a lower forward side of said smooth arm member, and means for securing said utility blade between said smooth pressure plate and the lower forward side of said smooth arm member in a proper position perpendicular to said slot, so that when the threaded shank of said thumbscrew bears against the smooth elongated rule of the conventional T-square said person can grip said smooth arm member and slide the smooth head of the conventional T-square along the one straight edge of the plasterboard sheet, said securing means includes a pair of spaced apart pressure plate screws each of which extends through said smooth pressure plate and into said smooth arm member, so that said utility blade is properly positioned in a downwardly angular direction by said pressure plate screws between said smooth pressure plate and the lower forward side of said smooth arm member, and a utility blade screw which threadably extends through said smooth pressure plate to bear against said utility blade, so as to keep the blade stationary in the proper position without passing through the blade so that any utility blade can be used.

2. An improved cutter for a plasterboard sheet as recited in claim 1, wherein said smooth base member and said smooth arm member are integral with said one end of said smooth base member and the lower forward side of said smooth arm member being aligned to form a flat surface.

3. An improved cutter for a plasterboard sheet as recited in claim 2, wherein the smooth elongated rule of the conventional T-square includes a calibrated scale placed upon a top surface thereof, so that the end of said smooth base member can be set at an identifiable location on said calibrated scale such that the piece of the plasterboard sheet that is to be snapped off along the score line can be precisely measured.

4. An improved cutter for a plasterboard sheet as recited in claim 3, wherein said smooth base member and said smooth arm member are fabricated out of one of a number of durable materials, such as at least metal and plastic.

5. An improved cutter for a plasterboard sheet as recited in claim 4, wherein said smooth pressure plate is fabricated out of one of a number of durable materials, such as at least metal and plastic.

6. An improved cutter for a plasterboard sheet as recited in claim 5, wherein said pressure plate screws and said utility blade screw are fabricated out of one of a number of durable materials, such as at least metal and plastic.

* * * * *